US007240858B2

(12) United States Patent
Wang

(10) Patent No.: US 7,240,858 B2
(45) Date of Patent: Jul. 10, 2007

(54) TRIGGER MECHANISM FOR WATERING NOZZLES

(76) Inventor: King-Yuan Wang, P.O. Box 487, Chang-Hua City 500 (TW)

( * ) Notice: Subject to any disclaimer, the term of this patent is extended or adjusted under 35 U.S.C. 154(b) by 175 days.

(21) Appl. No.: 11/139,471

(22) Filed: May 31, 2005

(65) Prior Publication Data

US 2006/0266851 A1 Nov. 30, 2006

(51) Int. Cl.
*B05B 7/02* (2006.01)

(52) U.S. Cl. ..... 239/526; 239/525; 239/581.1; 239/582.1; 239/395

(58) Field of Classification Search ..... 239/526, 239/525, 527, 581.1, 582.1, 393, 395, 390, 239/443, 447, 437
See application file for complete search history.

(56) References Cited

U.S. PATENT DOCUMENTS

| | | | | |
|---|---|---|---|---|
| 5,806,770 | A * | 9/1998 | Wang | 239/391 |
| 6,007,003 | A * | 12/1999 | Wang | 239/525 |
| 6,073,863 | A * | 6/2000 | Wang | 239/525 |
| 6,279,839 | B1 * | 8/2001 | Chang | 239/525 |
| 6,367,716 | B1 * | 4/2002 | Wang | 239/526 |
| 6,390,390 | B1 * | 5/2002 | Hung | 239/525 |
| 6,425,533 | B1 * | 7/2002 | Shilton et al. | 239/290 |
| 6,431,468 | B1 * | 8/2002 | Brown et al. | 239/526 |
| 6,460,782 | B1 * | 10/2002 | Wang | 239/390 |
| 6,536,688 | B1 * | 3/2003 | Chun-Lee | 239/581.1 |
| 6,641,062 | B1 * | 11/2003 | Chen | 239/526 |
| 6,648,246 | B1 * | 11/2003 | Chang | 239/526 |
| 6,702,206 | B2 * | 3/2004 | Wu | 239/526 |
| 6,866,208 | B2 * | 3/2005 | Kao | 239/526 |
| 7,025,291 | B2 * | 4/2006 | Wu | 239/526 |
| 7,080,795 | B2 * | 7/2006 | Chen | 239/394 |
| 7,124,965 | B1 * | 10/2006 | Chen | 239/525 |
| 2005/0001070 | A1 * | 1/2005 | Wu | 239/526 |
| 2005/0178857 | A1 * | 8/2005 | Roman | 239/526 |
| 2005/0178858 | A1 * | 8/2005 | Roman | 239/526 |
| 2005/0274826 | A1 * | 12/2005 | Chen | 239/526 |
| 2006/0097076 | A1 * | 5/2006 | Mueller et al. | 239/526 |
| 2006/0266851 | A1 * | 11/2006 | Wang | 239/526 |
| 2006/0273205 | A1 * | 12/2006 | Wang et al. | 239/526 |

FOREIGN PATENT DOCUMENTS

JP 06277564 A * 10/1994

* cited by examiner

*Primary Examiner*—Kevin Shaver
*Assistant Examiner*—Trevor McGraw

(57) ABSTRACT

A trigger mechanism for watering nozzles includes a trigger whose lower end is pivotably connected to the handle and an activation rod has a first end inserted into a tube in the handle and a second end of the activation rod is in contact with the inside of the trigger. The first end of the activation rod may push a valve member in the tubular path in the handle to allow water to flow through the path and enter the barrel of the watering nozzle. The trigger can be fixed at operation position by pulling a movable member located above the trigger.

6 Claims, 7 Drawing Sheets

TRIGGER MECHANISM FOR WATERING NOZZLES

FIELD OF THE INVENTION

The present invention relates to a watering nozzle and more particularly, to a trigger and water adjustment mechanism for watering nozzles.

BACKGROUND OF THE INVENTION

A conventional watering nozzle generally includes a handle connected with a hose so that water enters into the handle and a valve assembly is received in the handle and the valve assembly is cooperated with the trigger which can be pulled to activate the valve assembly to allow the water to flow through the barrel of the watering nozzle. One of the trigger mechanisms used on the watering nozzles includes a gear which is movably connected to the trigger and an engaging plate with toothed periphery can be movably engaged with the gear by pulling the trigger. By the engagement of the engaging plate and the gear, the user may control the volume of water entering the nozzle. However, the engaging plate and the gear are received in the handle and the user cannot see them so that when pulling the trigger to engaging the engaging plate with the gear, the users cannot be sure whether or not that the engaging plate is matched with the gear as desired. Sometimes, the users have to engage the engaging plate and the gear by way of try and error. The gear might be shifted by the movement of the engaging plate. Besides, the engaging plate is a thin plastic plate which might be deformed and cannot be perfectly engaged with the gear.

SUMMARY OF THE INVENTION

The main object of the present invention is to provide a watering nozzle that is reliable, less expensive and easily to be assembled.

Another object of the present invention is to provide a watering nozzle that can be operated by one hand.

The present invention relates to a watering nozzle that comprises a handle and a barrel connected to a top of the handle. A head and a pattern member are connected to a front open end of the barrel. A tubular path is located in the handle and communicates with an open bottom of the handle. A tubular portion extends into the handle from the open bottom of the handle and communicates with the tubular path. An inner diameter of the tubular portion is larger than that of the tubular path. A valve member is movably received in the tubular portion and a portion of the valve member is received in and seals the tubular path. A tube is connected to the tubular path and an activation rod is movably inserted into the tube. A first end of the activation rod contacts the valve member so as to push the valve member to unseal the path. A trigger has a lower end thereof pivotably connected to the handle and a second end of the activation rod is in contact with an inside of the trigger. A lock portion extends from a top of the trigger. A movable member has a rail on a top thereof so as to be movably inserted in a groove in the barrel. A recess is defined in a rear end of the movable member and the guide pin is inserted into the recess. A second spring is mounted to the guide pin to keep the movable member to be located at un-pulled position. A positioning plate extends from an inside of the movable member and is capable of keeping the lock portion of the trigger at an operation position.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
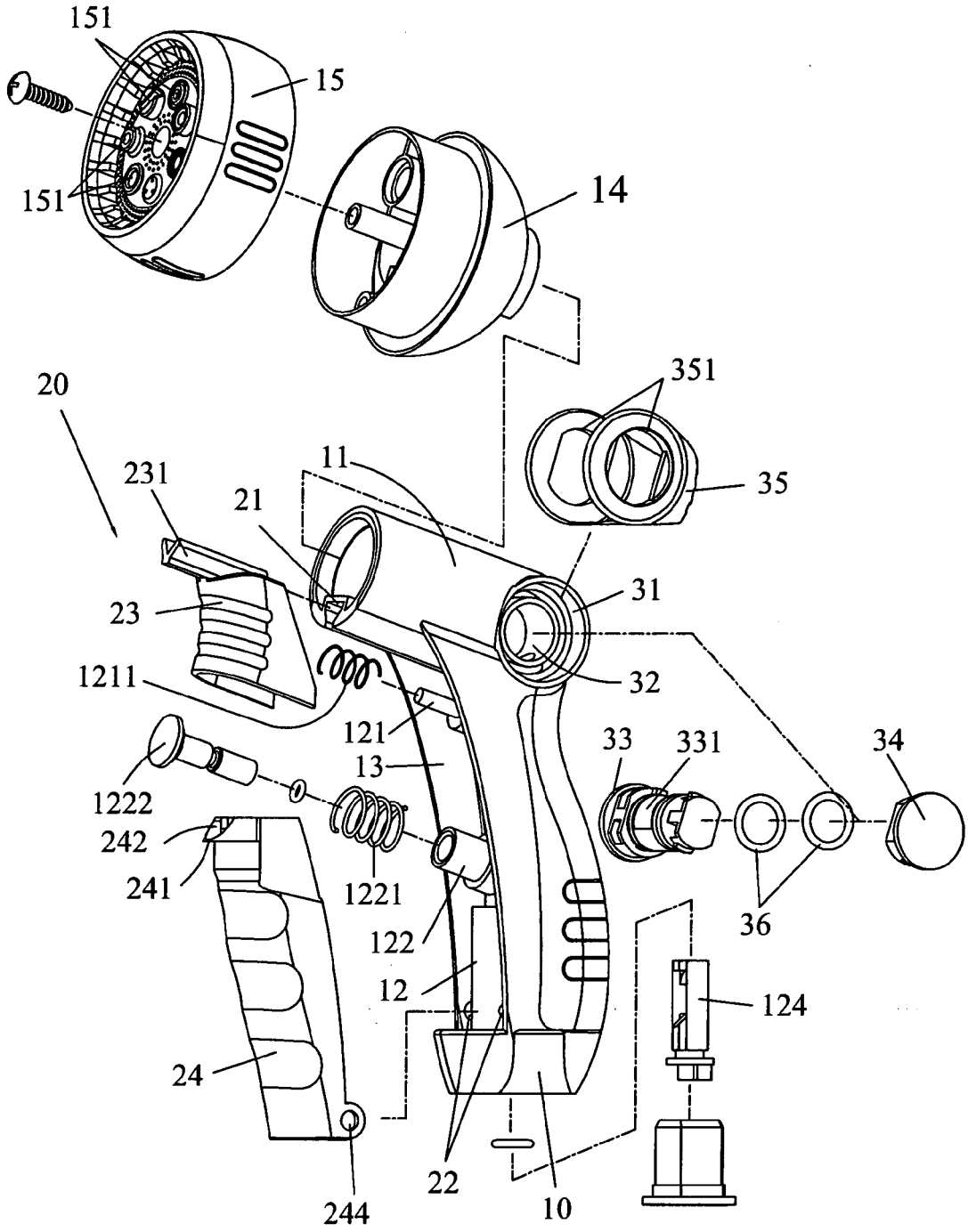
FIG. 1 is an exploded view to show the watering nozzle of the present invention.
Figure 2:
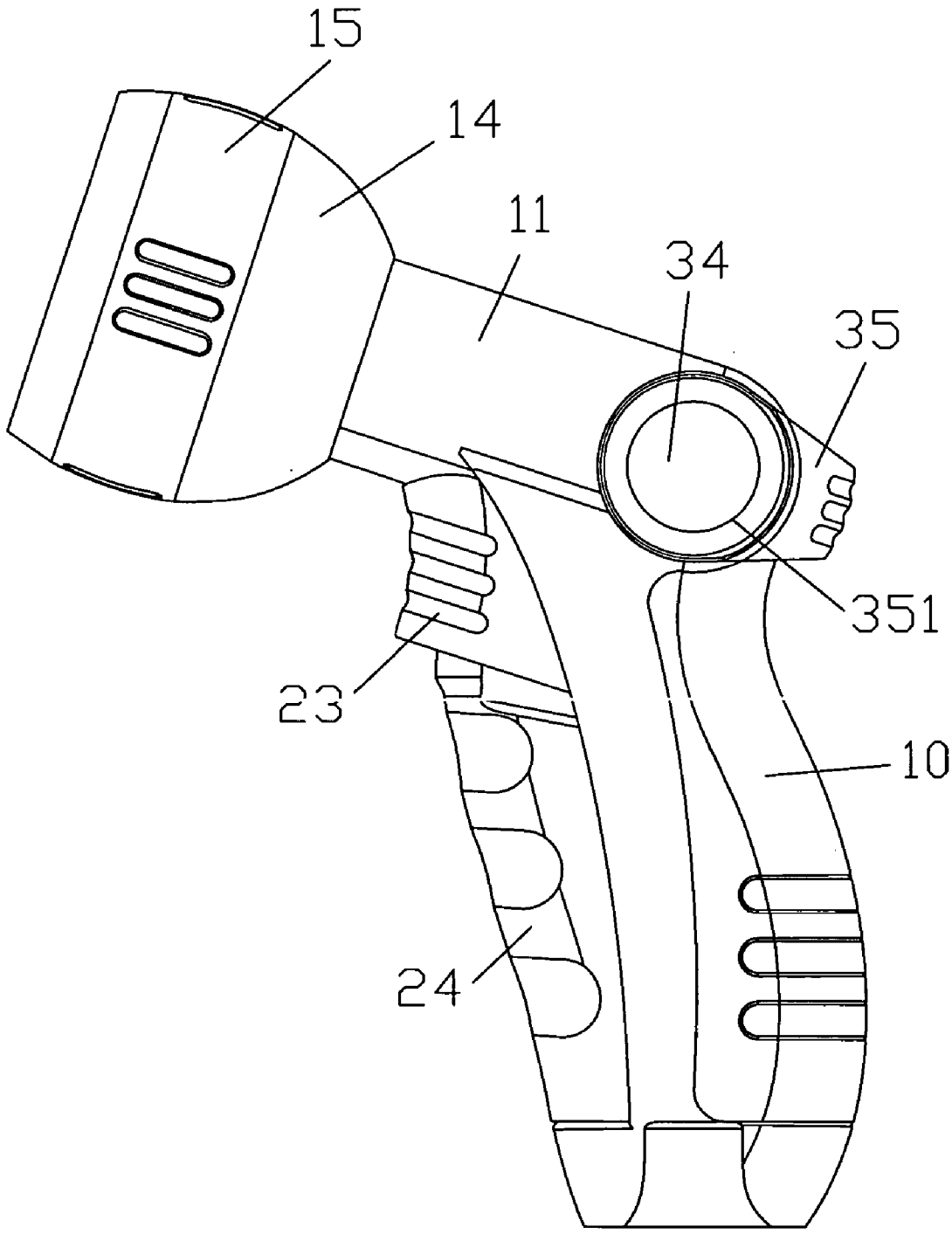
FIG. 2 is a side view to show the watering nozzle of the present invention.
Figure 4:
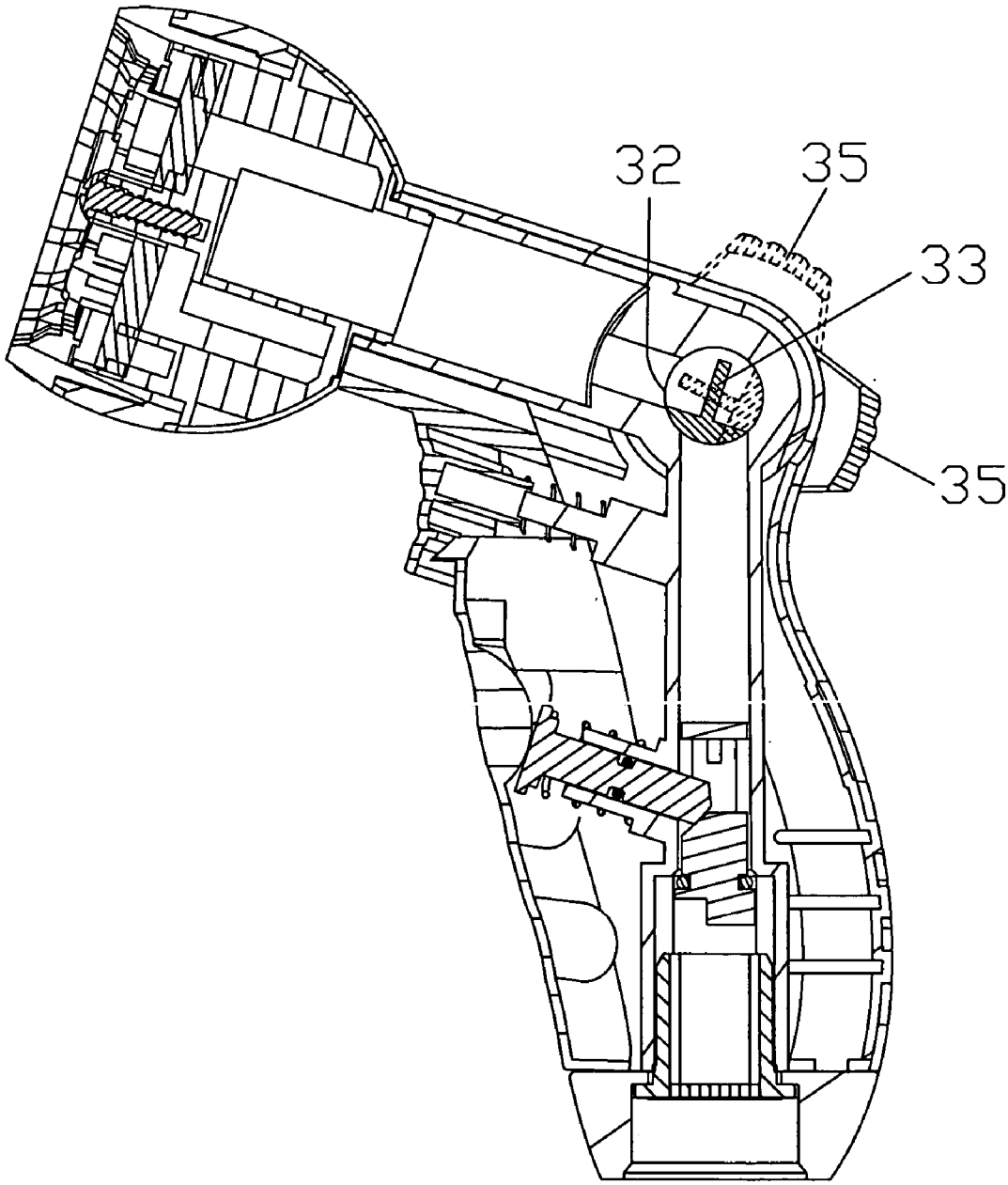
FIG. 4 is a cross sectional view to show the trigger is not yet pulled.

Referring to FIGS. 1, 2 and 4, the watering nozzle of the present invention comprises a handle 10 which includes an open bottom so as to be connected with a hose (not shown) and a tubular path 12 is located in the handle 10 and communicates with the open bottom of the handle 10. A tubular portion 123 extends into the handle 10 from the open bottom of the handle 10 and communicates with the tubular path 12. An inner diameter of the tubular portion 123 is larger than that of the tubular path 12. A valve member 124 is movably received in the tubular portion 123 and a portion of the valve member 124 is received in and sealing the tubular path 12 so as to seal the tubular path 12. A tube 122 is connected to the tubular path 12 and an activation rod 1222 is movably inserted into the tube 122. A first end of the activation rod 1222 contacts an inclined surface of the valve member 124 such that when the activation rod 1222 is operated to push the valve member 124 toward the tubular portion 123, the tubular path 12 is unsealed and water may flow through the path 12. A first spring 1221 is mounted to the activation rod 1222 to keep the activation rod 1222 to extend away from the tubular path 12. A guide pin 121 extends from an inside of the handle 10. A barrel 11 is connected to a top thereof and a head 14 is connected to a front open end of the barrel 11. A pattern member 15 is rotatably mounted to the head 14. A plurality of pattern holes 151 are defined in the pattern member 15 so that water flows out from desired pattern holes 151 by rotating the pattern member 15.

A trigger mechanism 20 includes a trigger 24 which includes two lugs 244 extending from a lower end thereof and the two lugs 244 are pivotably connected to two protrusions 22 extending from two opposite insides of the handle 10. The trigger 24 is engaged with an open front side 13 of the handle 10. A second end of the activation rod 1222 is in contact with an inside of the trigger 24. A lock portion 241 extends from a top of the trigger 24 and the lock portion 241 includes an open top 242.

A movable member 23 has a rail 231 on a top thereof so as to be movably inserted in a groove 21 defined in an inner periphery of the barrel 11. A recess 232 is defined in a rear end of the movable member 23 and the guide pin 121 is inserted into the recess 232. A second spring 1211 is mounted to the guide pin 121 to keep the movable member 23 to be located at un-pulled position. A positioning plate 233 extends from an inside of the movable member 23.

A transverse passage 31 is defined through the barrel 11 and includes a hole 32 which is in communication with the tubular path 12 and an interior of the barrel 11. A valve piece 33 with two seals 36 on two ends thereof are rotatably extends through the transverse passage 31 and an end member 34 is fixed to one of two ends of the valve piece 33. The valve piece 33 includes a radial hole 331 which is rotated with the valve piece 33 to communicate with the tubular path 12. A lever 35 has two rings 351 which are mounted to two ends of the valve piece 33. One of the two rings 351 includes a polygonal hole with which a polygonal end of the valve piece 33 is engaged. Therefore, the valve piece 33 is rotated by operating the lever 35 and the radial hole 331 can be controlled to be in communication with the tubular path 12 as desired so as to control the volume of the water entering the barrel 11.

Figure 3:
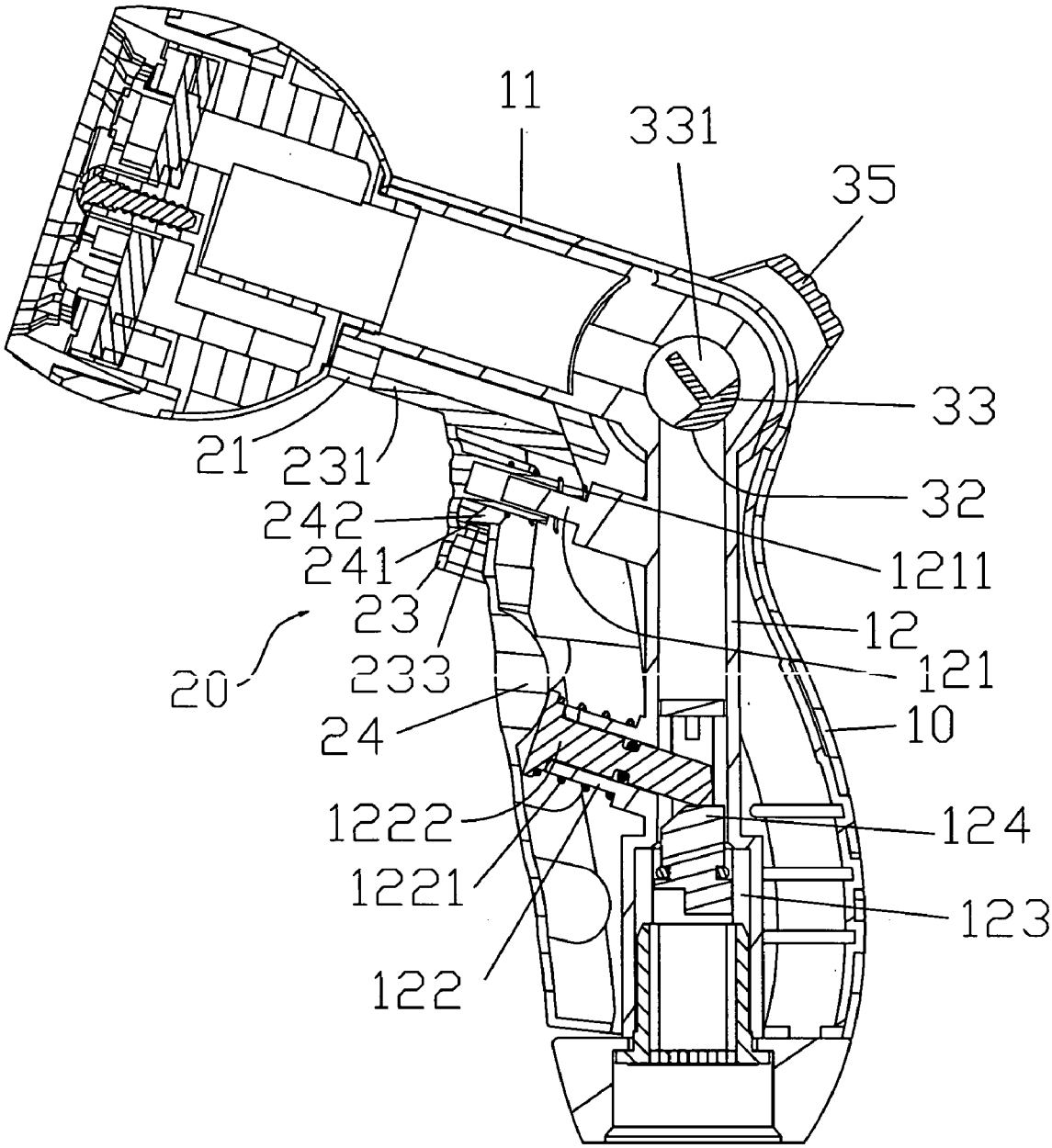
FIG. 3 is a cross sectional view to show the trigger is pulled.
Figure 5:
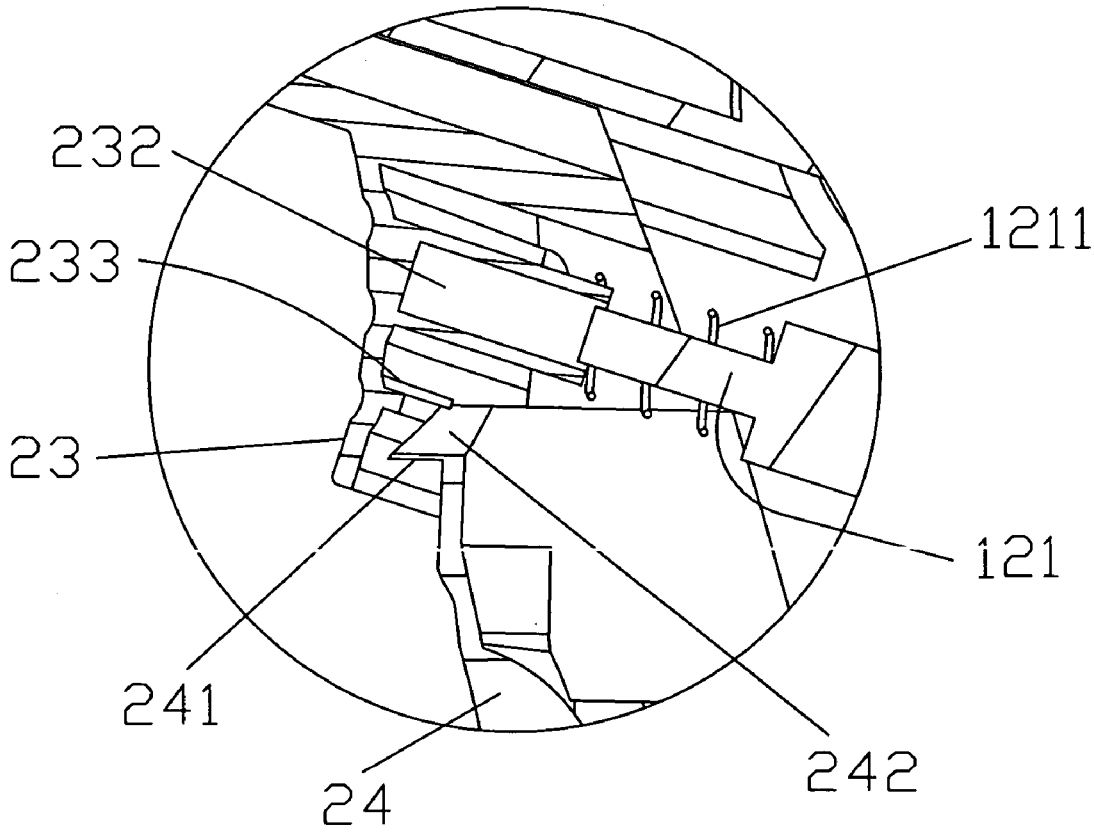
FIG. 5 is an enlarged view to show the movable member is not yet pulled to lock the trigger.
Figure 6:
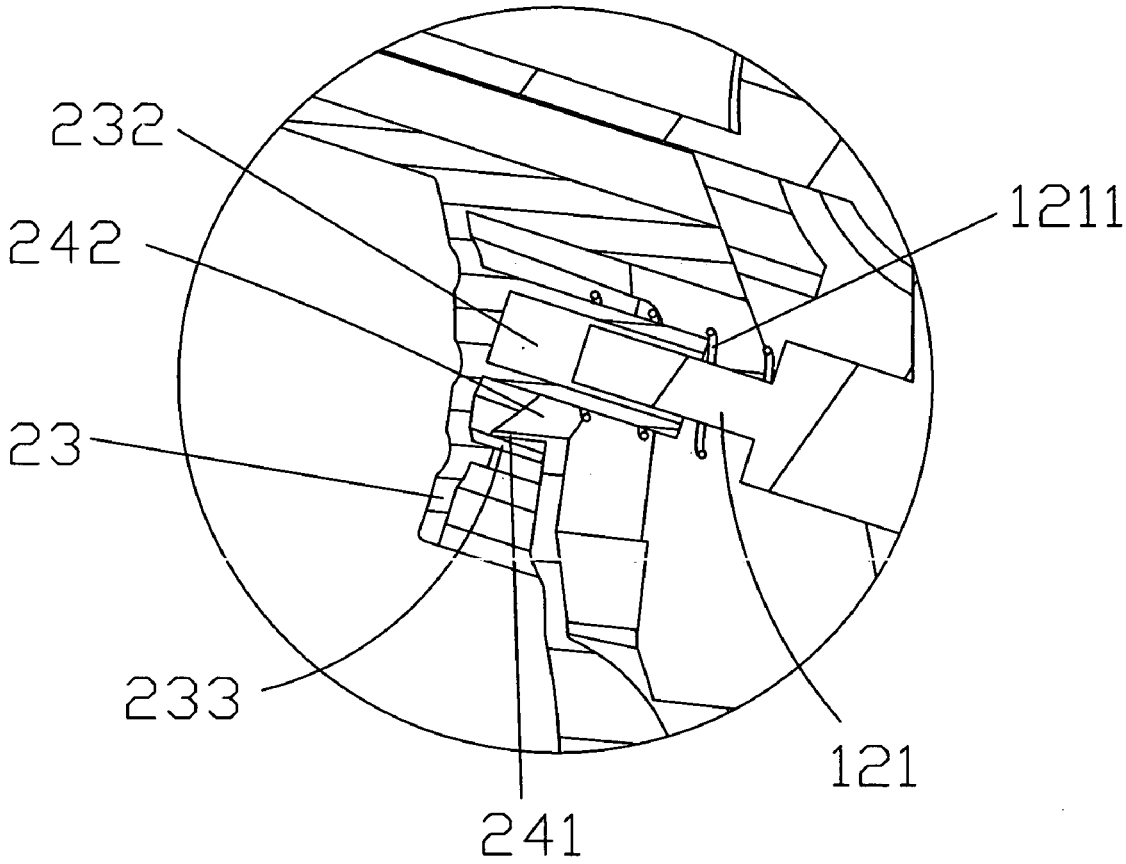
FIG. 6 is an enlarged view to show the movable member is pulled to lock the trigger.

When pulling the trigger 24, the valve member 124 is pushed into the tubular portion 123 by the first end of the activation rod 1222 and water enters the barrel 11 via the path 12. The user may hold the trigger to operate the nozzle and the lock portion 241 is located beneath the positioning plate 233 as shown in FIG. 5. As shown in FIGS. 3 and 6, when the trigger 24 is held, the user may pull the movable member 23 to move the positioning plate 233 to a position beneath the lock portion 241. Due to the spring forces from the first and second springs 1221, 1211, and the lock portion 241 and the positioning plate 233 interconnect with each other at an angle, the trigger 24 is stopped by the positioning plate 233. The user needs not hold the trigger 24 which is kept at the operation position.

Figure 7:
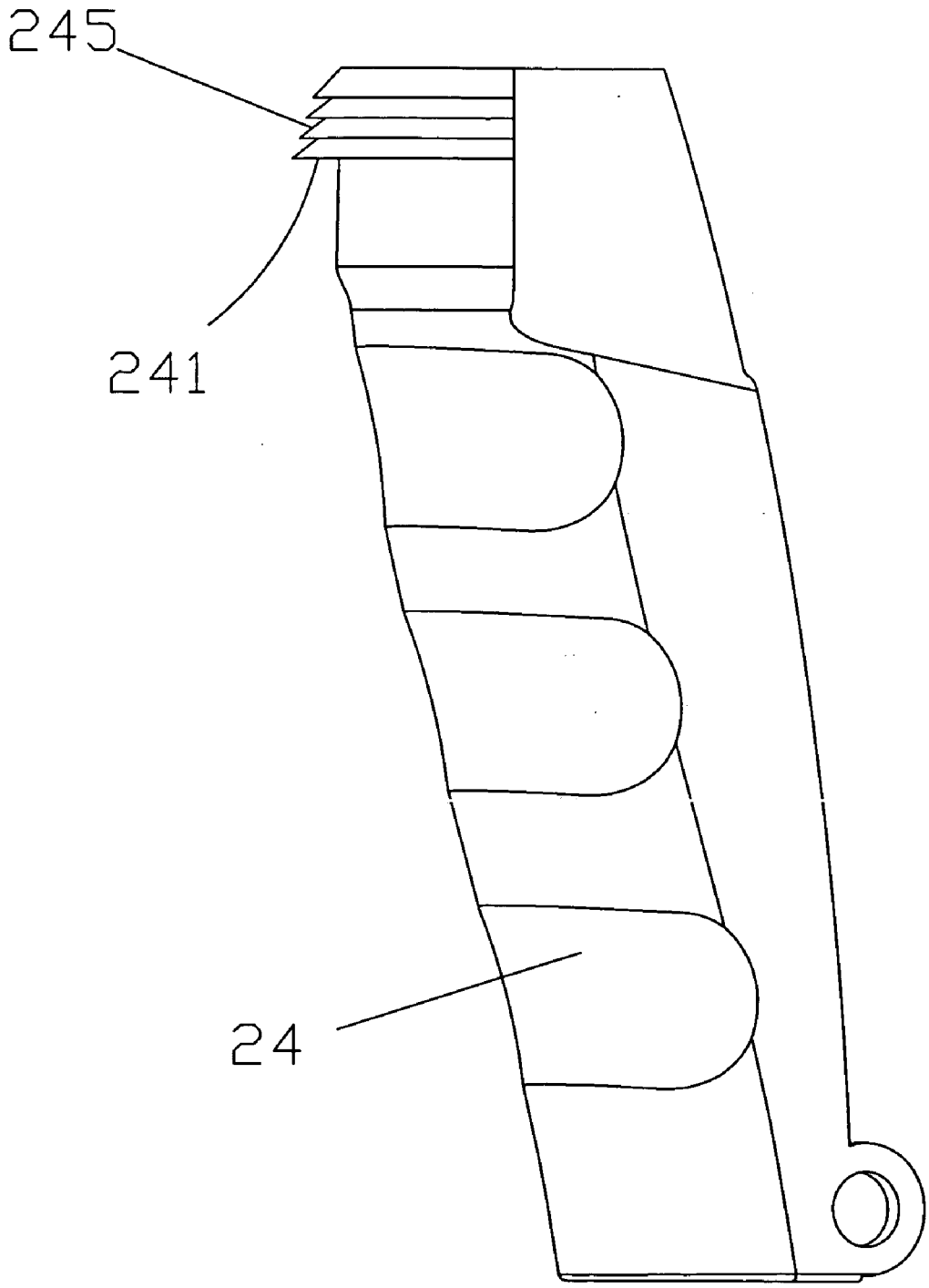
FIG. 7 shows a second embodiment of the trigger of the present invention.

FIG. 7 shows a second embodiment of the trigger 24 of the present invention, wherein the lock portion 241 includes a plurality of steps 245 which include different radial lengths as shown so as to position the positioning plate 233 at different positions. By this way, the trigger 24 is set at different positions so as to control the volume of water entering the tubular path 12.

While we have shown and described the embodiment in accordance with the present invention, it should be clear to those skilled in the art that further embodiments may be made without departing from the scope of the present invention.

What is claimed is:

1. A watering nozzle comprising:

a handle having a barrel connected to a top thereof, a head is connected to a front open end of the barrel and a pattern member rotatably mounted to the head, a plurality of pattern holes defined in the pattern member, a groove defined in an inner periphery of the barrel, a tubular path located in the handle and communicating with an open bottom of the handle, a tubular portion extending into the handle from the open bottom of the handle and communicating with the tubular path, an inner diameter of the tubular portion being larger than that of the tubular path, a valve member movably received in the tubular portion and a portion of the valve member received in and sealing the tubular path, a tube connected to the tubular path and an activation rod movably inserted into the tube and a first end of the activation rod contacting the valve member so as to push the valve member toward the tubular portion, a first spring mounted to the activation rod to keep the activation rod to extend away from the tubular path, a guide pin extending from an inside of the handle;

a trigger having a lower end thereof pivotably connected to the handle and a second end of the activation rod being in contact with an inside of the trigger, a lock portion extending from a top of the trigger, and a movable member having a rail on a top thereof so as to be movably inserted in the groove in the barrel, a recess defined in a rear end of the movable member and the guide pin inserted into the recess, a second spring mounted to the guide pin to keep the movable member to be located at un-pulled position, a positioning plate extending from an inside of the movable member and being capable of keeping the lock portion of the trigger at an operation position.

2. The nozzle as claimed in claim 1, wherein the valve member has an inclined surface on which the first end of the activation rod is in contact therewith so that when the first end of the activation rod pushes on the inclined surface, the valve member moves into the tubular portion and the tubular path is unsealed.

3. The nozzle as claimed in claim 1, wherein two protrusions extend from two opposite insides of the handle and two lugs on the lower end of the handle, the two lugs are pivotably connected to the two protrusions.

4. The nozzle as claimed in claim 1, wherein a transverse passage is defined through the barrel and includes a hole which is in communication with the tubular path and an interior of the barrel, a valve piece rotatably extends through the transverse passage and includes a radial hole which is rotated with the valve piece to communicate with the tubular path, a lever has two rings which are mounted to two ends of the valve piece so that the valve piece is rotated by operating the lever.

5. The nozzle as claimed in claim 4, wherein one of the two rings includes a polygonal hole with which a polygonal end of the valve piece is engaged.

6. The nozzle as claimed in claim 1, wherein the lock portion includes a plurality of steps which include different radial lengths relative to the axial direction of the trigger so as to position the positioning plate at different positions.

* * * * *